United States Patent [19]

Dutra, Jr.

[11] 4,354,795

[45] Oct. 19, 1982

[54] LOAD STABILIZER ASSEMBLY WITH PIVOTAL MOUNT FOR A FORKLIFT TRUCK

[76] Inventor: Joseph G. Dutra, Jr., 4568 Thornton Ave., Fremont, Calif. 94536

[21] Appl. No.: 234,408

[22] Filed: Feb. 13, 1981

[51] Int. Cl.[3] ..... B66F 9/18

[52] U.S. Cl. ..... 414/622; 414/607; 410/52; 294/67 AB

[58] Field of Search ..... 212/187, 188; 410/717-721, 52, 68, 69; 414/607, 619-623, 733; 280/47.28; 294/88, 103 R, 67 AB

[56] References Cited

U.S. PATENT DOCUMENTS

| | | | |
|---|---|---|---|
| 2,561,896 | 7/1951 | Weiss | 414/607 |
| 2,684,165 | 7/1954 | Hill | 414/622 |
| 2,772,800 | 12/1956 | Brady | 414/622 |
| 2,799,417 | 7/1957 | Morrell | 414/622 |
| 2,807,382 | 9/1957 | Schenkelberger | 414/620 |
| 2,828,039 | 3/1958 | Puim | 414/622 |
| 2,832,489 | 4/1958 | Bailey | 414/607 |
| 2,875,912 | 3/1959 | Thresher et al. | 414/622 |
| 3,024,929 | 3/1962 | Shimmon | 414/420 |
| 3,133,655 | 5/1964 | Gardner | 414/620 |
| 3,272,364 | 9/1966 | Mindrum et al. | 414/622 |
| 3,477,601 | 11/1969 | Gardner et al. | 414/622 X |
| 3,567,053 | 3/1971 | Willock | 414/620 |
| 3,797,684 | 3/1974 | Brandt | 414/420 |
| 3,817,567 | 6/1974 | Lull | 294/88 |
| 3,851,777 | 12/1974 | Dilny | 414/607 |
| 4,136,793 | 1/1979 | Dutra, Jr. | 414/622 |

FOREIGN PATENT DOCUMENTS

| | | | |
|---|---|---|---|
| 132666 | 6/1949 | Australia . | |
| 532056 | 10/1956 | Canada . | |
| 2309845 | 9/1973 | Fed. Rep. of Germany | 414/622 |
| 854323 | 11/1960 | United Kingdom | 414/622 |
| 267471 | 7/1970 | U.S.S.R. | 414/622 |

*Primary Examiner*—Robert J. Spar
*Assistant Examiner*—Terrance L. Siemens
*Attorney, Agent, or Firm*—Manfred M. Warren; Robert B. Chickering; Glen R. Grunewald

[57] ABSTRACT

A load stabilizer for a forklift truck is disclosed which includes pivotal mounting means formed for selective movement between a deployed position over the forklift tines to a stored position in front of the forklift mast. The hydraulic drive means used to raise and lower the clamp structure also enables powered movement of the clamp structure between the deployed and stored positions.

13 Claims, 7 Drawing Figures

LOAD STABILIZER ASSEMBLY WITH PIVOTAL MOUNT FOR A FORKLIFT TRUCK

BACKGROUND OF THE INVENTION

While the advantages of employing a load stabilizer or box clamp assembly on a forklift truck to clamp, secure or stabilize a load carried by the tines or forks of the truck are well known, there remains a substantial disadvantage which has limited use of such stabilizer assemblies to applications in which they are absolutely essential, namely, the inability to compactly store the clamp assembly while mounted to the forklift. Thus, the safety advantages which would accrue from use of a load stabilizer are often short-cut because of the impossibility or awkwardness of storing the stabilizing unit when not in use.

Most forklift load stabilizers include a horizontally extending arm which acts as a clamp and is reciprocally mounted to a frame immediately in advance of the forklift mast. The arm is driven by hydraulic means, such as a hydraulic cylinder, so that it may be selectively brought into engagement with the load carried by the truck so as to stabilize the same in combination with the forklift tines. Typical forklift load stabilizers or box clamps are shown in my prior U.S. Pat. No. 4,136,793 and the prior art cited in that patent.

In my U.S. Pat. No. 4,136,793 a load stabilizer assembly is provided which can be moved to a stored position in which it is not superimposed over the tines of the forklift. Thus, the assembly is formed so that it can be pivoted about vertical axes to a position over the body of the forklift truck to permit towing of the truck. While this ability to store the stabilizer or box clamp has been found to have substantial advantages, it is not designed to permit storage of the box clamp in a position which enables active use of the forklift for tasks that do not require the stabilizer.

While most load stabilizers or box clamp assemblies include horizontal arms which are rigidly fixed with respect to the vertical framework or carriage upon which they reciprocate, U.S. Pat. No. 3,272,364 discloses a clamp structure for a forklift which is pivotally mounted so as to provide two positions for carrying cartons. This specialized clamp structure of this forklift, however, extends only a very short distance outwardly of the forklift mast because it is designed for use with relatively short forks of the type employed to carry boxes or drums. A similar short-fork structure is shown in U.S. Pat. No. 2,807,382. The clamp mechanisms in these patents, however, are not similar to the load stabilizer or box clamp mechanisms which extend a substantial distance from the forklift and thereby present a much more substantial storage problem when not in use.

Typical of the relatively large clamp structures to which the present invention is directed are the structures in U.S. Pat. Nos. 2,684,165, 2,875,912, 3,024,929, 3,133,655, and 3,567,053.

OBJECTS OF THE INVENTION

Accordingly, it is an object of the present invention to provide a load stabilizer assembly for a forklift truck which enables compact storage of relatively large clamping mechanisms of the type which extend in the deployed position outwardly of the truck a substantial distance over the forklift tines.

Another object of the present invention is to provide a load stabilizer assembly in which the clamping structure can be easily and quickly moved between a deployed position and a stored position.

Still another object of the present invention is to provide a load stabilizer assembly which can be stored in a position on a forklift truck in which the load engaging clamping surface is disposed in the stored position to assist in the support and control of the load.

Still another object of the present invention is to provide a box clamp assembly for a forklift truck or the like in which the clamp drive mechanism can be used to move the clamp between a stored and a deployed position.

A further object of the present invention is to provide a load stabilizer for a forklift truck which is durable, requires little service, can be easily attached to virtually all models of forklift trucks, is easy to operate and is relatively inexpensive to manufacture.

The forklift truck load stabilizer of the present invention has other objects and features of advantage which will become apparent from and are set forth in more detail in the accompanying drawing and the following detailed description of the preferred embodiments.

SUMMARY OF THE INVENTION

The load stabilizer of the present invention includes assembly mounting means formed for mounting of the assembly to a forklift truck proximate the forklift tines and preferably in front of the forklift mast. The assembly includes clamp means extending outwardly of the assembly and formed with a downwardly facing load engaging surface. The improvement in the load stabilizer assembly which enables compact storage of the clamp means is comprised, briefly, of pivotal mounting means coupling the clamp means to the remainder of the assembly with the mounting means including arm means, a first pivotal connection coupling the arm means to the remainder of the assembly, a second pivotal connection coupling the arm means to the clamp means, and latch means formed for latching the arm means in a deployed position extending away from the remainder of the assembly and formed for selective release of the arm means for movement to a stored position proximate the remainder of the assembly. The pivotal connections and arm are further formed for rotation of the arm in a first direction upon release of the latch means and rotation of the clamp in an opposite direction during pivotal movement so as to dispose the load engaging surface of the clamp facing outwardly of the assembly, preferably in a generally vertical orientation, immediately in front of the mast so that the load engaging surface may assist in stabilizing the end of the load nearest to the forklift mast. Additionally, drive means for the assembly is coupled through the first pivotal connection to enable pivotal movement of the assembly between the deployed and stored positions, as well as vertical reciprocation of the clamp structure when latched in the deployed position.

DESCRIPTION OF THE PREFERRED EMBODIMENTS

Figure 1:
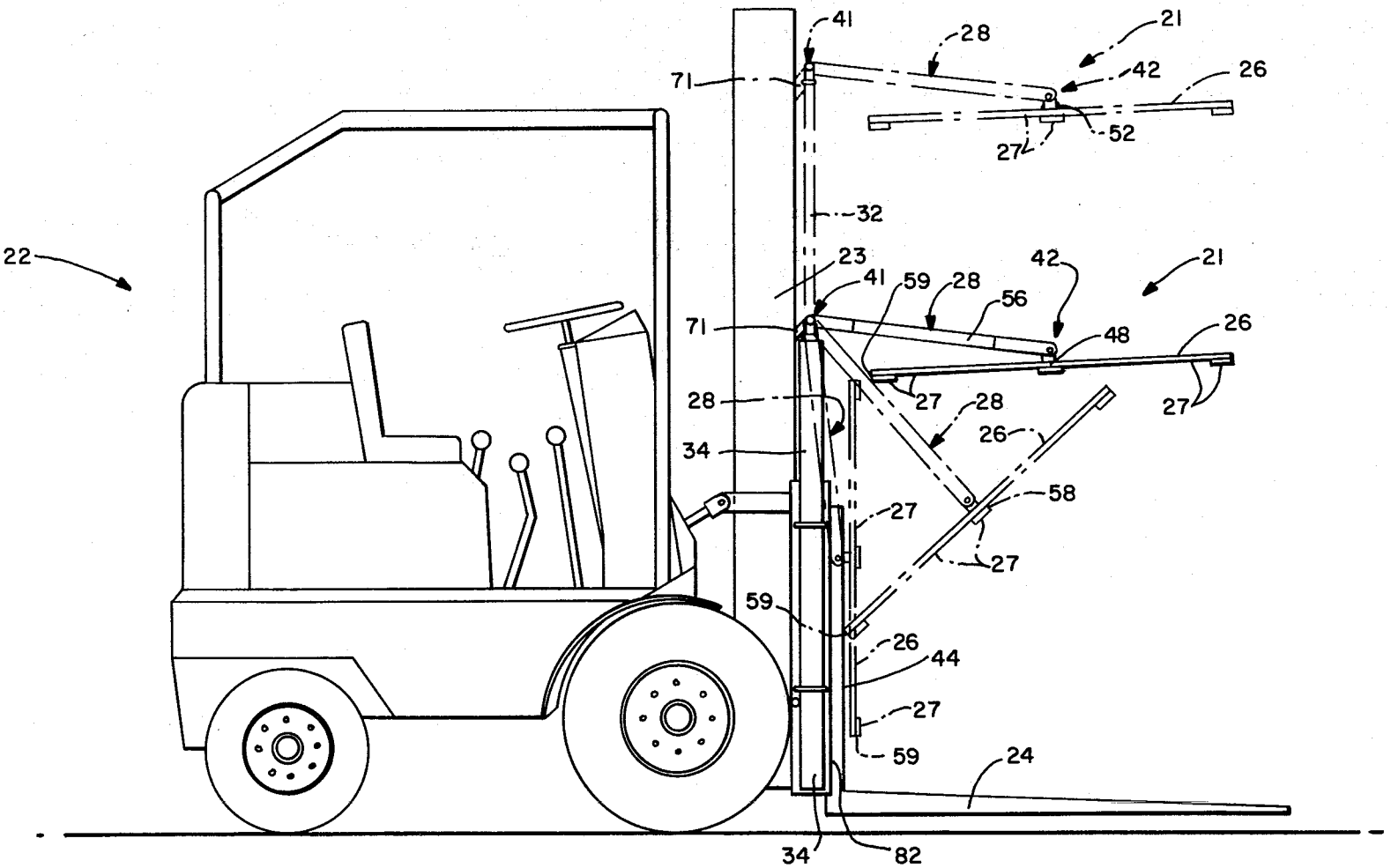
FIG. 1 is a side elevational view of a forklift truck having a load stabilizer assembly constructed in accordance with the present invention mounted thereto, with moved positions shown in phantom.

The load stabilizer assembly of the present invention, generally designated 21, is a formed for mounting to the front of a forklift truck 22 or the like, usually by mounting proximate the mast 23 on which forklift tines 24 are reciprocally carried. As will be appreciated, there is a wide variety of forklift trucks on the market which are used for a wide variety of applications. The present invention, however, relates most particularly to the general purpose forklit truck of the type in which tines 24 extend a substantial distance in advance of mast 23 to permit carrying of rather bulky loads on forklift pallets. Thus, as can best be seen in FIG. 1, stabilizer 21 includes clamp means 26 which extends outwardly of mast 23 over a length or distance which is substantial and about equal to the length of tines 24 so that the downwardly facing load engaging surfaces 27 of clamp 26 will be superimposed over virtually all of the load to enable clamping or stabilizing of the same in cooperation with the tines.

As is typical of box clamp and load stabilizer structures, the horizontally extending clamp means or structure 26 is mounted by arm means, generally designated 28, to an assembly frame which includes cross member 29 (FIG. 2) carried by vertical frame members 31 and 32, which in turn are mounted for vertical sliding reciprocation inside frame guide sleeves or cylinders 33 and 34. Vertical reciprocation of the clamp structure 26 is accomplished by means of a hydraulic cylinder 36 having hydraulic fluid supply lines 37 and a piston 38 which is coupled to a cross bar 29 in a matter which will be described in more detail hereinafter. Thus, the hydraulic lines 37 can be coupled in a convenient manner to the hydraulic system and pump used to drive the forklift tines and available on essentially all forklift trucks.

Clamp or stabilizer structure 26, therefore, can be vertically reciprocated by means of drive means or hydraulic cylinder 36 independently of raising or lowering of forklift tines 24. This permits vertical adjustment of the clamp with respect to the tines so as to enable clamping of loads of various heights, and the box clamp or load stabilizer structure thus far described is typical of the apparatus found in the prior art.

As will be appreciated from FIG. 1, while the load stabilizer assembly affords the advantages of being suitable for clamping or support of the upper surface of a load, it can also impair the maneuverability of the forklift truck by reason of the distance to which it extends in front of the mast, and it can limit the height of loads. Accordingly, the improved load stabilizer assembly of the present invention is formed with pivotal mounting means coupling clamp means 26 to the remainder of the clamp assembly for movement of the clamp means from a deployed position, extending horizontally in front of the forklift truck, to a stored position, extending substantially vertically proximate the front of the forklift truck. The pivotal mounting means includes a first pivotal connection 41 proximate a first or inner end of arm 28 and the remainder of the assembly. The pivotal mounting means of the load stabilizer assembly further includes a second pivotal connection 42 proximate an outer or second end of arm 28 which couples clamp means 26 to arm 28.

Figure 4:
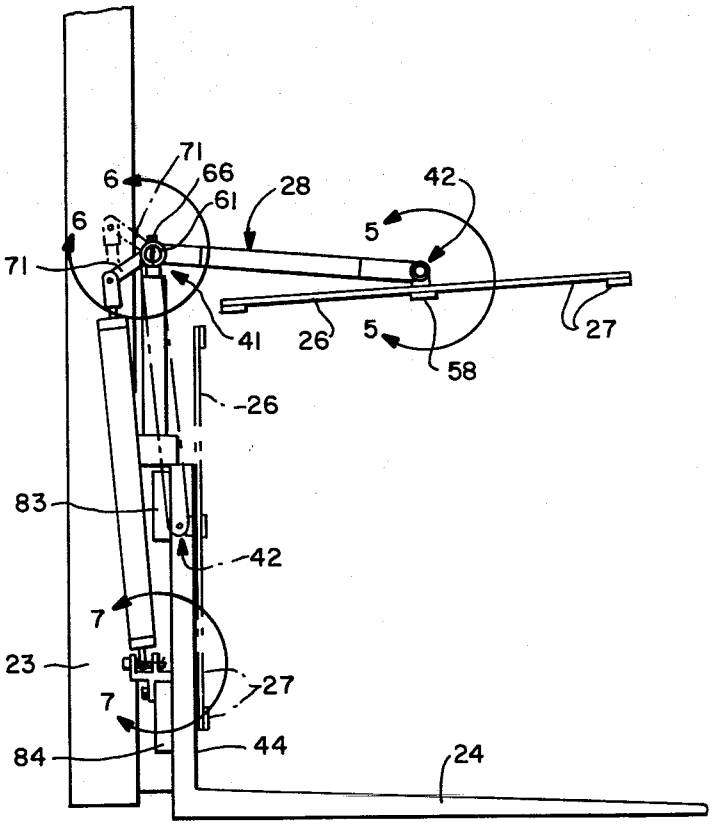
FIG. 4 is a side elevational view taken substantially along the plane of line 4—4 in FIG. 2.
Figure 3:
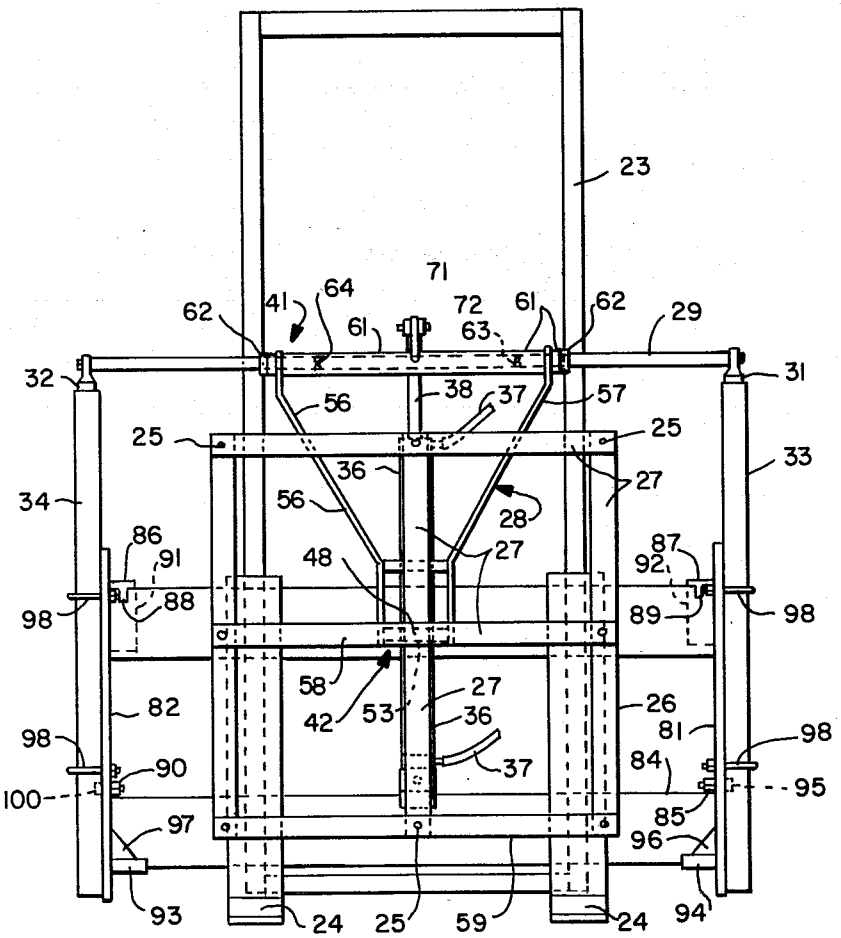
FIG. 3 is a front elevational view corresponding to FIG. 2 with the load stabilizer shown in a stored position.

In order to enable selective locking or latching of the clamp structure in a deployed or horizontal position and in a stored position, the pivotal mounting means further includes latch means 43 formed to enable latching of arm 28 in the deployed position (shown in solid lines in FIGS. 1 and 4) and formed for selective release of arm 28 for movement to a stored position proximate the remainder of the stabilizer assembly (as is shown in phantom in a vertical orientation in FIGS. 1 and 4 and in solid lines in FIG. 3).

Figure 6:
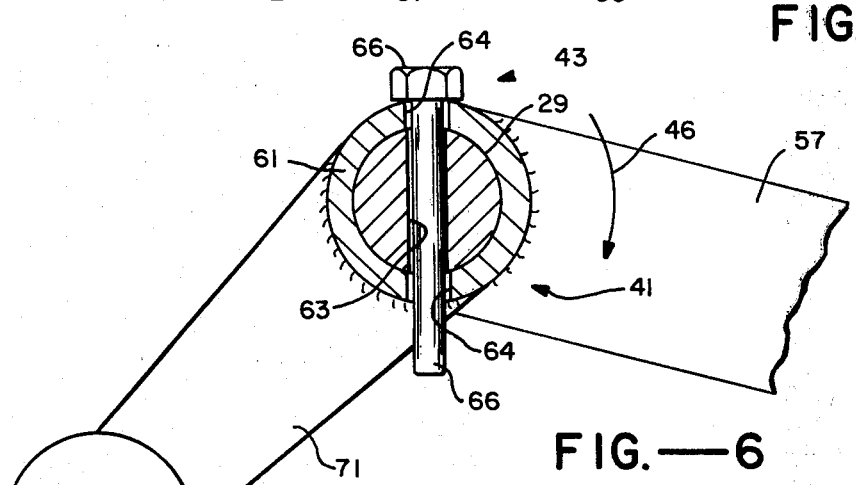
FIG. 6 is an enlarged, fragmentary, side elevational view of the area bounded by the line 6—6 in FIG. 4.

In FIG. 6 it will be seen that arm 28 pivots in a downwardly or first direction about first pivotal connection 41 upon release of latch means 43, as indicated by arrow 46. By comparison, clamp means 26 rotates in an opposite or second direction about second pivotal connection 42, as indicated by arrow 47, during movement of the clamp structure from the deployed to the stored position. The clamp means, therefore, is moved to a generally parallel orientation to the remainder of the load stabilizer assembly with load engaging surface 27 facing outwardly to enable engagement of an end of the load carried by the tines when the clamp is in a stored position. As will be seen from FIGS. 1, 3, and 4, when the clamp structure is in the stored position it not only leaves the area over the forklift tines completely unobstructed, but it provides additional support for the end of the load, which can be quite significant and helpful when the load is comprised of a plurality of units, such as small boxes, which can become separated from each other.

It is preferable that second pivotal connection 42 be secured to clamp means 26 at about the midpoint 48 of the length to which the clamp extends from the load stabilizer assembly. As can be seen in FIG. 3, pivotal connection 42 is secured to clamp structure 46 at about the center of the area of the clamp structure. Such a securement of the second pivotal connection to the clamp structure facilitates the almost folding pivotal action during storing of the unit, and enhances the compactness with which the clamp structure can be stored against the front end of the forklift truck.

Figure 5:
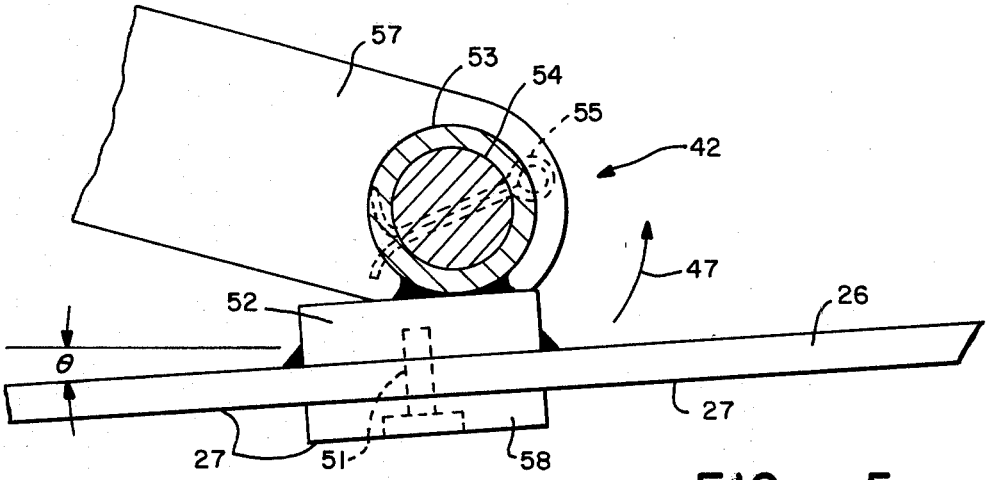
FIG. 5 is an enlarged, fragmentary, side elevational view of the area bounded by the line 5—5 in FIG. 4.

Additionally, as best may be seen in FIG. 5, it is preferable to secure clamp structure 26 to pivotal connection 42 proximate and slightly in advance of the center of gravity along the length dimension of the clamp means to cause the clamp means to be supported from arm 28 in a slightly rearwardly tilted orientation. Thus, clamp 26 is secured by fastener 51 to a block 52, which in turn is welded to a sleeve 53 pivotally mounted on transverse bar 54. Arm means 28 is provided by a pair of arm members 56 and 57 with transverse bar 54 extending across and through the distal ends and connected between arm members 56 and 57 by cotter pins 55 or the like. The securement of block 52 by fastener 51 is directly over the middle strap member 58 of the clamp structure, but block 52 and the entire clamp structure is displaced slightly toward the forklift in its connection to sleeve 53 so that the clamp hangs at a slightly rearwardly tilted orientation, as indicated by angle $\theta$.

The rearward tilt of the clamp structure in the deployed position tends to cause the structure to fold properly as arm means 28 rotates downwardly. The inner edge 59 drops into contact with structural member 44 as arm 28 pivots downwardly and the tilt insures counter-rotation of the clamp so that the load engaging surfaces 27 are outwardly facing in the stored position.

It should also be noted that it is preferable for the second pivotal connection 42 to be formed for free rotation of the clamp means about a horizontal axis. This permits fore and rearward tilting of the clamp structure to adjust more evenly to the upper surface of the load being carried. The rearward tilt of the clamp in the deployed position, however, is immediately overcome by rotation of the second pivotal connection 42 upon engagement of surfaces 27 with the top surface of the load being stabilized. Notwithstanding free pivotal mounting of clamp 26 to arm 28, the reaction of the clamp structure to the load allows a substantial clamping force to be applied to the load through arm 28 and connection 42.

The details of construction of the first pivotal connection and latch means 43 are best seen by reference to FIG. 6. In the preferred form of pivotal connection 41, arm members 56 and 57 are rigidly secured for rotation to horizontally extending sleeve 61, which is rotatably mounted on cross bar member 29. Maintenance of sleeve 61 in a centered position over the length of bar 29 is accomplished by a pair of collar members 62 (FIG. 3) which are locked by set screws to bar 29 and defined therebetween a length of the bar on which sleeve 61 is mounted.

In order to latch or lock the rotable sleeve to cross bar member 29, vertically extending bores 63 are provided in bar 29 and mating bores 64 are provided in sleeve 61. Latch or lock pins 66 can then be passed through bores 64 and 63 to lock the sleeve and bar together as a unit when bore 64 is aligned with bore 63, which occurs when arm means 28 is in the deployed position. Thus, lock or latch pins 66 can either be dropped through the aligned bores to latch the arm in the deployed position at first pivotal connection 41 or can be removed from the aligned bores to permit rotation at pivotal connection 41 to the stored position. Preferably pins 66 are secured by a short cable or chain to sleeve 61 so that they will not become lost when removed. Since the ends of bar 29 are rigidly secured to vertical frame members 31 and 32, which in turn are reciprocally mounted in guide tubes 33 and 34, pinning of the sleeve to bar 29 by latch pins 66 prevents rotation of the clamp structure. As will be appreciated, other latch structures are suitable for use with the load stabilizer pivotal mount of the present invention.

It is a further important aspect of the load stabilizer assembly of the present invention to utilize the drive means or hydraulic cylinder 36 to not only vertically reciprocate the clamp structure for clamping, but also enable raising and lowering of the clamp structure to and from the deployed structure. As will be seen in FIG. 6, a crank or small arm 71 is rigidly secured for rotation to pivotal sleeve 61. The drive means for the load stabilizer unit is coupled for vertical displacement of the clamp by securement of an upper end 72 of hydraulic piston 38 to crank arm 71. Thus, a yoke 73 is mounted to the upper end 72 of the piston and is pinned at 74 to crank arm 71 to permit vertical displacement of the crank arm. When the sleeve 61 is pinned by latch means 43 against rotation with respect to bar 29, the entire bar and sleeve assembly will be vertically displaced by piston 38 of the drive means. When the latch pins are removed, displacement of piston 38 in an upward direction will produce rotation of arm 28 in a downward direction, as indicated by arrow 46, and cause the clamp means to be rotated to the stored position. Displacement of piston 38 downwardly will cause rotation of sleeve 61 in an opposite direction about bar 29 for movement of the clamp to the deployed position. Once the bores 63 and 64 are aligned, latch pins 66 can be dropped through the aligned bars and further displacement of the piston will either raise or lower the entire assembly to permit clamping or stabilization of loads.

Figure 2:
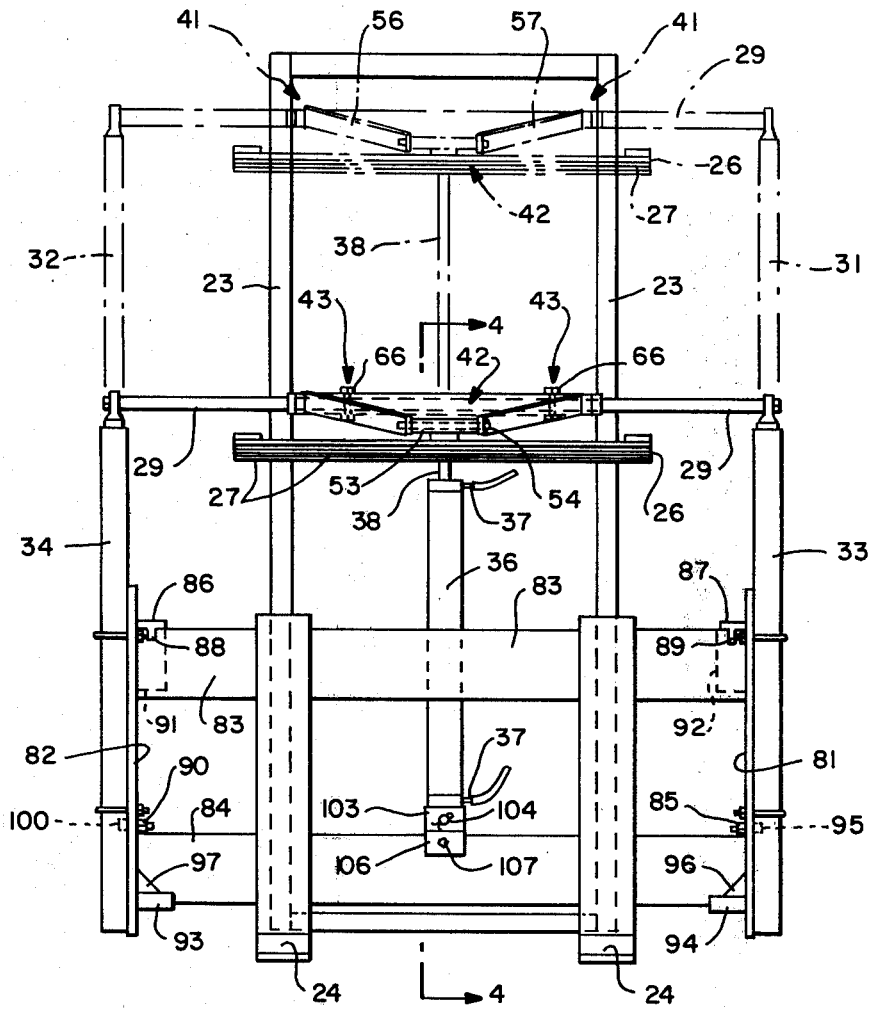
FIG. 2 is a front elevational view of the load stabilizer of FIG. 1 with the stabilizer shown in a deployed position.

It is a further important aspect of the present invention that the load stabilizer assembly is constructed in a manner which enables the entire assembly to be easily mounted to a wide variety of forklift trucks. As can be seen in FIGS. 2 and 3, the load stabilizer assembly includes assembly mounting means which are comprised of a pair of side mounting plates 81 and 82 formed to engage the ends of transverse forklift structural members 83 and 84. Extending from plates 81 and 82 over the top of the upper transverse member 83 are a pair of horizontally extending element 86 and 87, which have downwardly depending ears 88 and 89 on a front side of member 83. Also secured to plates 81 and 82 are backing plates 91 and 92 positioned on the inwardly facing side of transverse member 83. The assembly, therefore, can be slid over the ends of transverse member 83, and a bolt passed through openings drilled in member 83 to permit bolting of the ears 88 and 89 to the backing plates 91 and 92. On the lower transverse member 84 nuts 85 and 90 are welded to the top surface thereof. Bolts 95 and 100 are passed through openings in plates 81 and 82 to bolt the plates to the nuts welded to member 84. Additionally, U-shaped channels 93 and 94 with triangular plates 96 and 97 slide over the ends of member 84 and stabilize the bottom of the assembly. Finally, guide tubes 33 and 34 are clamped to mounting plates 81 and 82 by U-shaped bolts 98.

Figure 7:
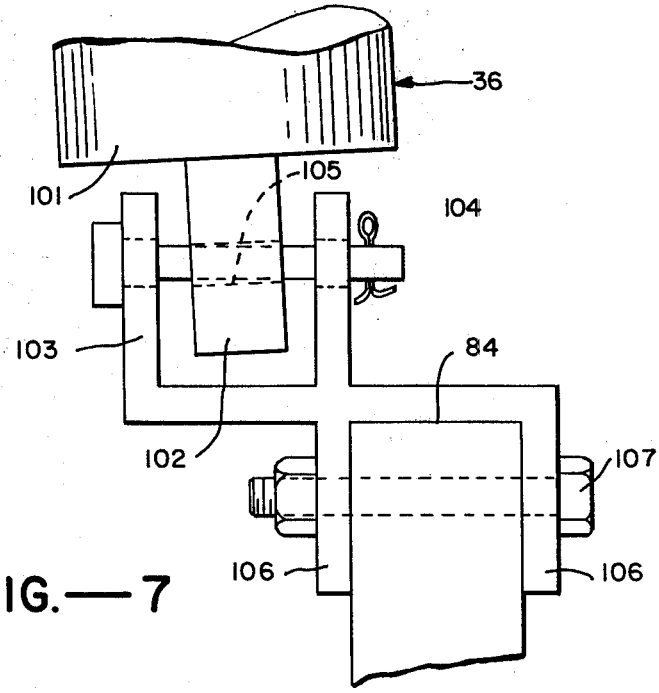
FIG. 7 is an enlarged, fragmentary, side elevational view of the area bounded by the line 7—7 in FIG. 4.

The mounting of drive means or hydraulic cylinder 36 to the forklift structure is shown in FIG. 7. As will be seen, the lower end 101 of cylinder 36 is provided with an ear 102 which is pinned to a yoke 103 by transverse pin 104. In order to accommodate tilting of the cylinder during pivoting of crank 71 pin 104 and the bores in ear 102 or yoke 103 should be a relatively loose fit. As shown, bore 105 is oversized as compared to pin 104.

The yoke 103 may be welded to either of transverse forklift structural members 83 or 84, or it may be secured by a second yoke structure 106 and a fastener 107. This latter structure enables the cylinder mount to be moved between lower structural member 84 to upper structural member 83, if desired, so as to change the range of displacement of the box clamp or load stabilizer to conform to the range of applications which the individual forklift user most frequently encounters. As will be apparent, such a change in range can also accomplished by changing the length of hydraulic cylinder 36, but the ability to mount to either of transverse forklift bars 83 and 84 enables the user to have a greater range of flexibility without the need for multiple drive cylinders of different lengths.

In order to enable ready replacement of movement parts, it is preferable that most of the parts be mounted for easy removal from the assembly for replacement. For example, the entire box clamp means 26 can be removed by pulling cotter pins 55 which secure the ends of transverse bar 54 to the ends of arm members 56 and 57. Once the cotter pins 55 are pulled, the bar can be removed and sleeve 53 dropped down from between the arm members for replacement of the clamp structure. Thus, clamps of various sizes and configurations can be mounted to the assembly.

The clamp structure 26 of the present invention is preferably comprised of an open grid, best seen in FIG. 3, of a first set of three strips extending in one direction and a second set of three strips extending in a perpendicular direction which are secured together with fasteners 25. This type of clamp is particularly good for boxes and for engaging loads having irregular upper surfaces that can protrude through the openings between the strips. Other structures are equally suitable for use with the assembly of the present invention.

In a similar manner, hydraulic cylinder 36 can be replaced, as can be the sleeve 61 and cross bar 29. One need only uncouple the upper end 72 of the piston from crank 71 and uncouple the pin 104 from yoke 103 to remove the cylinder. Moreover, when the hydraulic cylinder is uncoupled from crank arm 71, the entire bar and sleeve assembly can be lifted out of guide cylinders 33 and 34 to permit replacement thereof.

Accordingly, the load stabilizer assembly of the present invention can be mounted to a forklift which is used for a wide variety of applications. The assembly will mount to the forklift so that the clamp is in a stored position enabling use of the forklift in any conventional application. When the stabilizer is to be employed to stabilize loads, the hydraulic cylinder of the assembly can be used to raise the clamp structure to the deployed position as well as raise and lower the clamp structure to enable clamping of loads. The various components of the assembly may be easily replaced, making repair, maintenance, and even alteration of the load stabilizer inexpensive and easy to accomplish.

What is claimed is:

1. A load stabilizer assembly for a forklift truck or the like, said assembly including assembly mounting means formed for mounting said assembly to a forklift truck proximate the forklift tines, clamp means extending outwardly of said assembly as mounted proximate said tines and oriented in generally superimposed vertically spaced relation to said tines, said clamp means including a downwardly facing load engaging surface, and the remainder of the assembly wherein the improvement in said assembly enabling compact storage of said clamp means is comprised of:

pivotal mounting means coupling said clamp means to said remainder of said assembly, said pivotal mounting means including:

(a) arm means, (b) a first pivotal connection coupling said arm means to said remainder of said assembly, (c) a second pivotal connection coupling said arm means to said clamp means, and (d) latch means formed for latching said arm means in a deployed position extending away from said remainder of said assembly and formed for selective release of said arm means for movement to a stored position proximate said remainder of said assembly, said first pivotal connection, said second pivotal connection, and said arm means being further formed for rotation of said arm means in a first direction upon release of said latch means and rotation of said clamp means in an opposite direction during pivotal movement from said deployed position to said stored position, and said clamp means being moved to a generally parallel orientation to said remainder of said assembly when in said stored position with said load engaging surface facing outwardly of said assembly to enable engagement of a load carried by said tines.

2. The load stabilizer assembly as defined in claim 1 wherein, said clamp means when in said deployed position is formed to extend outwardly of said assembly to a length about equal to the length said tines extend from said forklift truck, said arm means is coupled to said clamp means by said second pivotal connection at about the midpoint of the length to which said clamp means extends from said assembly in the deployed position.

3. The load stabilizer assembly as defined in claim 2 wherein, said second pivotal connection is formed for free rotation of said clamp means about a horizontal axis in forward and rearward directions to permit adjustment of said clamping means to the upper surface of a load carried by said tines.

4. The load stabilizer assembly as defined in claim 3 wherein, said second pivotal connection is coupled to said clamp means proximate and in advance of the center of gravity along the length dimension of said clamp means to cause said clamp means to be supported from said arm means in a substantially horizontal but slightly rearwardly tilted orientation.

5. The load stabilizer assembly as defined in claim 1 wherein, said first pivotal connection is formed for downward rotation of said arm means about a horizontal axis during movement from said deployed position to said stored position, said second pivotal connection is formed for rotation about a horizontal axis in an opposite direction during movement from said deployed position to said stored position.

6. The load stabilizer assembly as defined in claim 5 wherein, said latch means is mounted proximate said first pivotal connection and is provided by a removable element formed for interengagement with said first pivotal connection to prevent rotation thereof.

7. The load stabilizer assembly as defined in claim 1 wherein, said clamp means is mounted to said assembly for vertical reciprocation with respect to said tines, drive means operatively coupled to said arm means for selective vertical reciprocation of said clamp means, said drive means being further operatively coupled to said arm means for rotational movement of said arm means about said first pivotal connection upon release of said latch means.

8. The load stabilizer assembly as defined in claim 7 wherein, said arm means is secured to a rotatable member of said first pivotal connection, a crank is secured to and extends from said rotatable member, said drive means being coupled to said crank, said rotatable member being rotably mounted to an assembly frame member, said frame member being mounted for vertical reciprocation with respect to said remainder of said assembly.

9. The load stabilizer assembly as defined in claim 8 wherein, said latch means is formed for selective locking of said rotatable member to said frame member against rotation.

10. The load stabilizer assembly as defined in claim 8 wherein, said frame member is provided by a horizontally extending bar coupled to a vertically extending frame portion, said frame portion being telescopically mounted to the remainder of said assembly for vertical reciprocation.

11. A load stabilizer assembly for a forklift truck or the like, said assembly including assembly mounting means formed for mounting said assembly to a forklift truck proximate the forklift tines, stabilizer means extending outwardly of said assembly in a deployed position vertically superimposed over said tines, said stabilizer means being mounted for vertical reciprocation with respect to said tines and including a downwardly facing load engaging surface, drive means operatively connected to said stabilizer means and formed to vertically displace said stabilizer means, said assembly being further formed for selective movement of said stabilizer means between said deployed position and a stored position, wherein the improvement in said assembly comprise:

pivotal mounting means formed to couple said stabilizer means to the remainder of said assembly for pivotal movement between said deployed position and said stored position, latch means formed to releasably secure said pivotal mounting means against pivotal movement, said drive means being coupled to one of said pivotal mounting means and said stabilizer and being coupled to pivotally drive said stabilizer upon release of said latch means between said deployed position and said stored position and being coupled to vertically displace said stabilizer when secured by said latch means in said deployed position.

12. The load stabilizer assembly as defined in claim 11 wherein, said pivotal mounting means is formed for pivotal movement of said stabilizer means from said deployed position with said load engaging surface facing downwardly to a stored position with said load engaging surface substantially vertically oriented and facing outwardly of said forklift truck.

13. The load stabilizer assembly as defined in claim 12 wherein, said drive means is provided as a hydraulic cylinder, and said pivotal mounting means includes an arm pivotally mounted proximate a first end to the remainder of said assembly and pivotally mounted proximate a second end to said stabilizer means proximate the center of the area of said load engaging surface of said stabilizer means.

* * * * *